US005629490A

United States Patent [19]

Inaba

[11] Patent Number: 5,629,490

[45] Date of Patent: May 13, 1997

[54] PIANO

[75] Inventor: Tatsuya Inaba, Hamamatsu, Japan

[73] Assignee: Kabushiki Kaisha Kawai Gakki Seisakusho, Shizuoka-ken, Japan

[21] Appl. No.: 699,681

[22] Filed: Aug. 14, 1996

Related U.S. Application Data

[63] Continuation of Ser. No. 406,842, Mar. 22, 1995, abandoned.

[30] Foreign Application Priority Data

Sep. 27, 1993 [JP] Japan ..... 5-240034

[51] Int. Cl.[6] ..... G10D 15/00

[52] U.S. Cl. ..... 84/171; 84/615; 84/20

[58] Field of Search ..... 84/170, 171, 172, 84/216, 219, 33, 21, 23, 615, 626

[56] References Cited

U.S. PATENT DOCUMENTS 5,374,775 12/1994 Kawamura et al. ..... 84/171

FOREIGN PATENT DOCUMENTS 59-58483 4/1984 Japan .
62-161198 7/1987 Japan .

*Primary Examiner*—Cassandra C. Spyrou
*Attorney, Agent, or Firm*—Davis and Bujold

[57] ABSTRACT

In a piano which is enabled to provide performance using electronic sound source as well as normal piano play, the proposed piano is such a piano where there is no difference of balance between the normal piano play and the play using electronic sound source. When key is moved in an electronic sound source mode, CPU detects a number n of the key (S110), detects a time lag Δ T between the timings at which blockage is caused between light emitting elements and light receiving elements of both key sensors (S120), and calculates a velocity V according to the time lag Δ T (S130). Then, performance data is prepared according to these key depression information, at the performance data preparation routine (S140), and a delay time Td corresponding to the velocity V is determined by using a delay time determination table (S150). Subsequently, it is determined whether the delay time Td has elapsed (S160). When it has elapsed, the performance data is outputted to the electronic sound source (S170). As a result, sound is created, with the delay time Td, according to the key depression intensity as an interval after the key depression.

8 Claims, 7 Drawing Sheets

PIANO

This application is a continuation of application Ser. No. 08/406,842 filed on Mar. 22, 1995 now abn.

TECHNICAL FIELD

This invention relates a piano having a mechanism which controls electronic sound source, in addition to conventional mechanism which creates performance by striking strings.

BACKGROUND ART

Such a piano has been proposed which has an electronic sound source combined with acoustic piano. This realizes performance using the electronic sound source as well as normal piano play.

In the stated kind of piano it is known to provide a mechanism which prevents the action caused by key depression from being transmitted to hammers such that normal play sound that would be otherwise created by striking strings (hereinafter referred to as string striking-sound) is eliminated during performance using electronic sound source. Thus, string striking-sound is not generated during the performance using electronic sound source.

During the performance using electronic sound source, stepped shutters and first and second key sensors, provided below keys and on the main body of a piano, respectively, serve as detection means for detecting actions related to key depression and key release. The first and second key sensors are comprised of a pair of a light emitting element and light receiving element. When there is a blockage between these elements, on-signal is generated. When a key is depressed, the stepped shutter first eclipses the light path of the first key sensor, and then, with a specified interval of time, eclipses the light path of the second key sensor. The timing and the time lag of such light path blockage at the first and second key sensors are detected by control means operating to control electronic sound source. The control means then prepares, according to control program, performance data in the form of control signal and sends it to the electronic sound source. Consequently, play sound is generated at the electronic sound source.

According to the described prior art, the output of the performance data by the control means toward the electronic sound source is simultaneous to the on-signal at the second key sensor. Therefore, once the light path is blocked at the second key sensor, sound goes off immediately after at the electronic sound source.

However, the string striking-sound generated when the piano is played as a normal piano is caused by the kinetic energy of key depression which is transmitted to a hammer and causes it to strike a string. Since such process takes a substantial time period, there is a difference between the sound emission, or note-on, timing of the string striking-sound during normal piano play and that of the sound generated at the electronic sound source, thereby leading to an imbalance of created performance as a whole between the normal piano play and a play using electronic sound source. As a result, a player feels awkward when he plays using one of the sound source after using the other sound source.

SUMMARY OF THE INVENTION

Wherefore, in pursuit of solution of the above described problem, an object of the present invention is to provide a piano enabled to be played using an electronic sound source as well as be played as a normal piano, wherein there is no difference of balance in performance as a whole between the normal piano play and a play using the electronic sound source.

In order to attain the above described object, the piano of the invention includes:

a mechanism to cause hammer to strike string in response to operation on keyboard; and an additional mechanism to control electronic sound source in response to the keyboard operation;

The piano further includes:

detection means for detecting action related to key depression and key release;

control means for controlling the electronic sound source according to the information sent from the detection means;

delay time determination means for determining a delay time by which sound emission at the electronic sound source controlled by the control means is delayed after detection of key depression by the detection means; and interception means for intercepting action of hammer when the control means is controlling the electronic sound source to create a performance.

The invention further including the feature that the delay time determination means determines a delay time at least according to key depression intensity.

The invention further including the feature that the delay time determination means determines a delay time with respect to each key or a key range.

When the piano of the present invention is played using the electronic sound source according to operation on the keyboard, key depression or key release is detected by the detection means, and according to such information the control means controls the electronic sound source, thereby generating electronic sound. Meanwhile, because of the interception means intercepting action of hammers, string striking-sound is not generated. Further, the delay time determination means determines a delay time by which sound emission at the electronic sound source controlled by the control means is delayed after detection of key depression by the detection means. Thus, the time period from key depression to actual note-on at the electronic sound source is equalized to the note-on timing during normal piano play, i.e. the time period during which key is depressed, hammer receives the kinetic energy and string is struck by the hammer to generate sound. In this way it is enabled to provide for the electronic sound source the same note-on timing as that of the normal piano play. Thus, there is no difference in the performance as a whole between the play using the electronic sound source and a normal piano play.

In the piano of the present invention, the delay time determination means determine a delay time according to at least key depression intensity. Therefore, it is enabled make the delay time longer as the key depression intensity is smaller, or shorter as the key depression intensity is greater, as in the ordinary piano. Hence, the note-on timing of normal piano play is faithfully imitated.

Further in the piano of the present invention, the delay time determination means determines a delay time with respect to each key or key range. For example, because in the ordinary piano the hammers corresponding to lower note are heavier and hammers corresponding to higher note are lighter in weight, the delay time period should be made longer for the key range of lower note, and shorter for the key range of higher note. Thus, the note-on timing of the ordinary piano can be faithfully imitated.

BRIEF EXPLANATION OF DRAWINGS

FIG. 6A is of less key depression intensity and FIG. 6B is of greater key depression intensity.

BEST MODE FOR CARRYING OUT THE INVENTION

The embodiment of the present invention will be now described with reference to the drawings.

Figure 1:
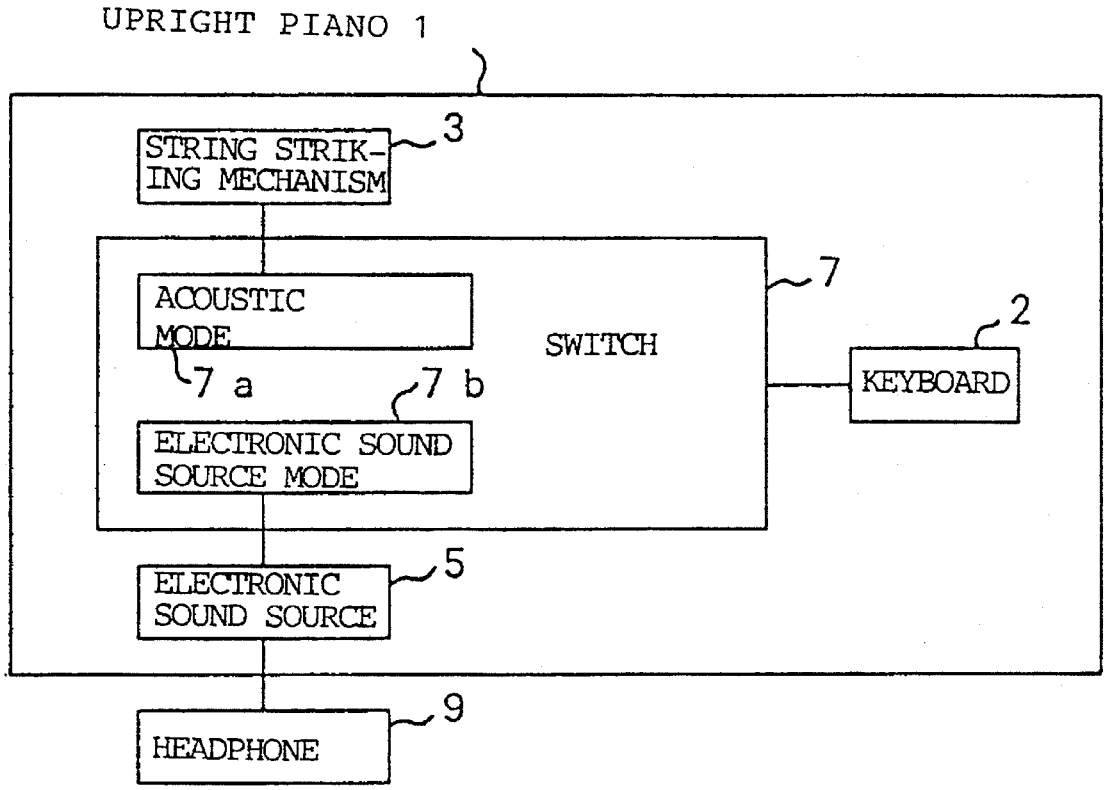
FIG. 1 is an explanatory view schematically showing the construction of the embodiment.
Figure 2:
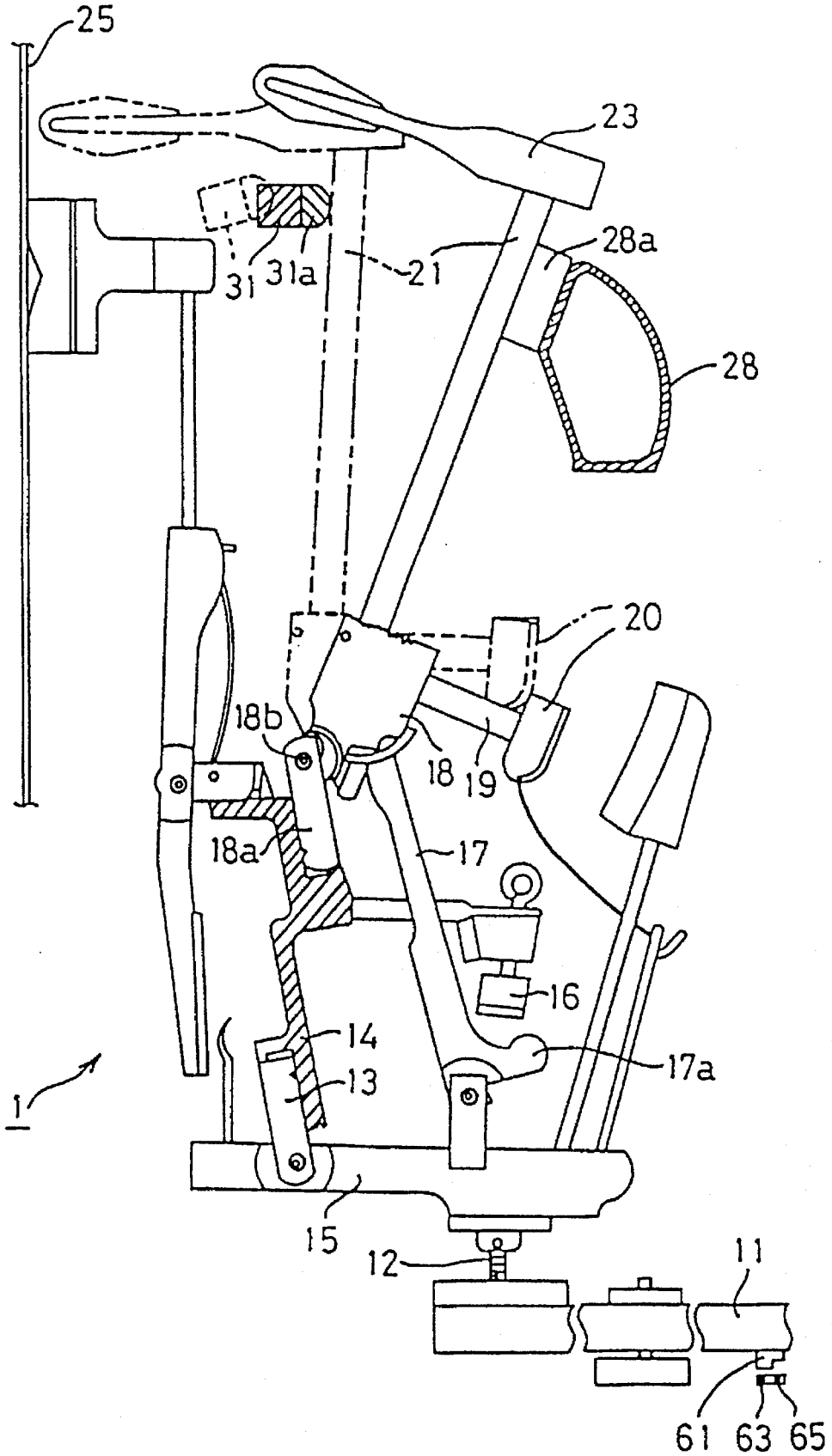
FIG 2 is an explanatory view of the interior structure of the upright piano of the embodiment.
Figure 3:
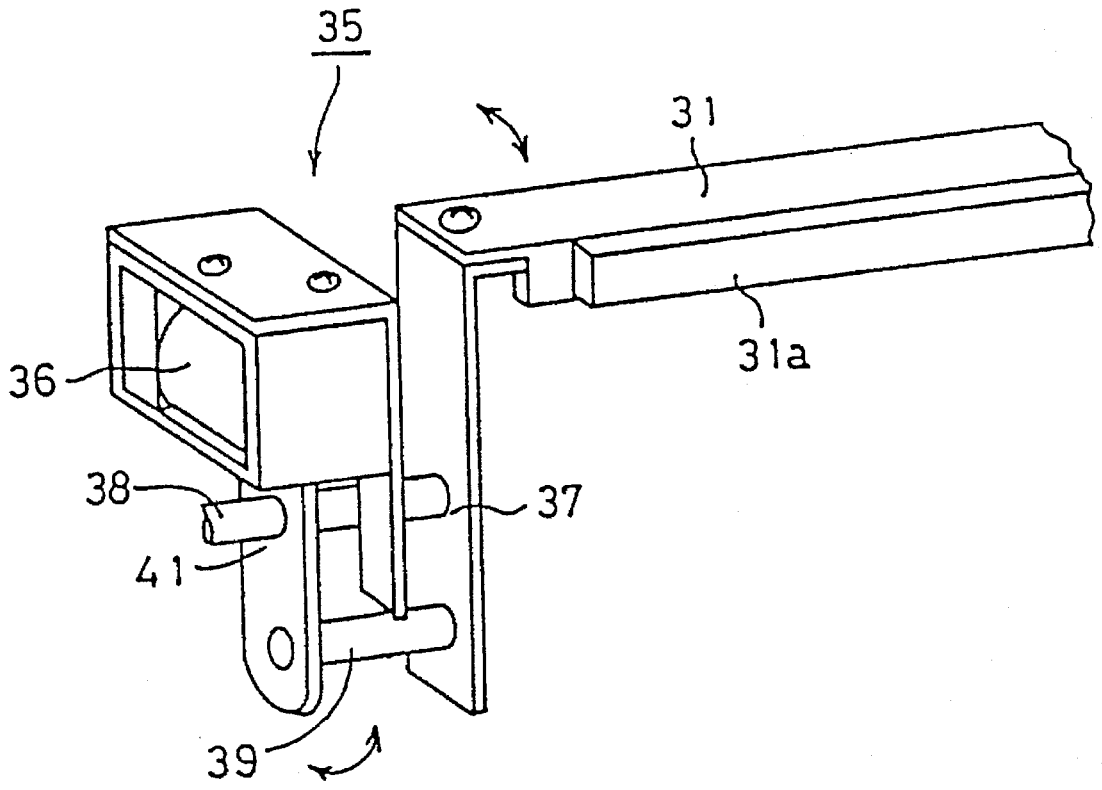
FIG. 3 is a perspective view of a lever elevation mechanism of the upright piano of the embodiment.
Figure 4:
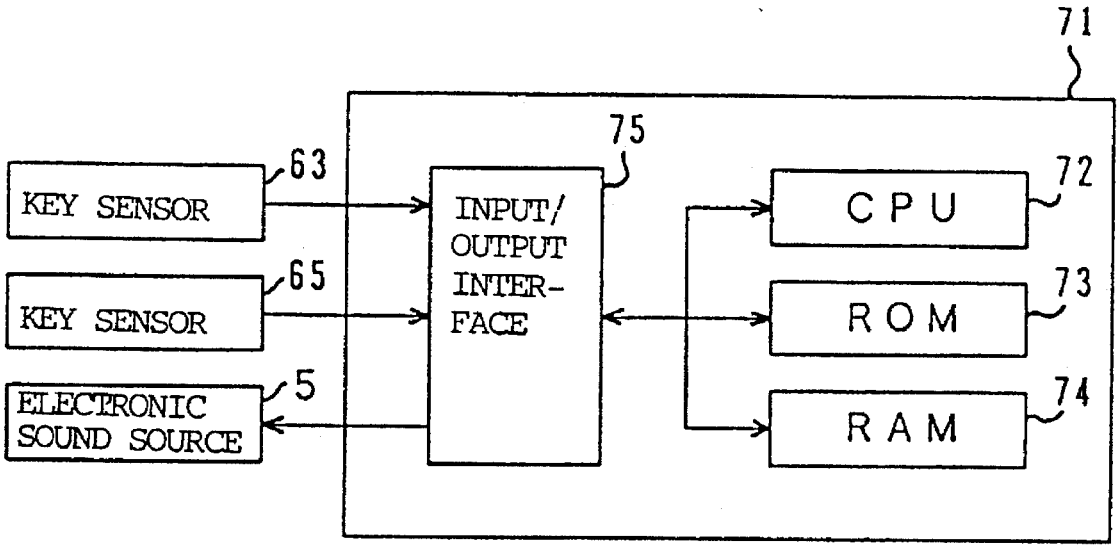
FIG. 4 is a block diagram showing control means of the upright piano of the embodiment.
Figure 5:
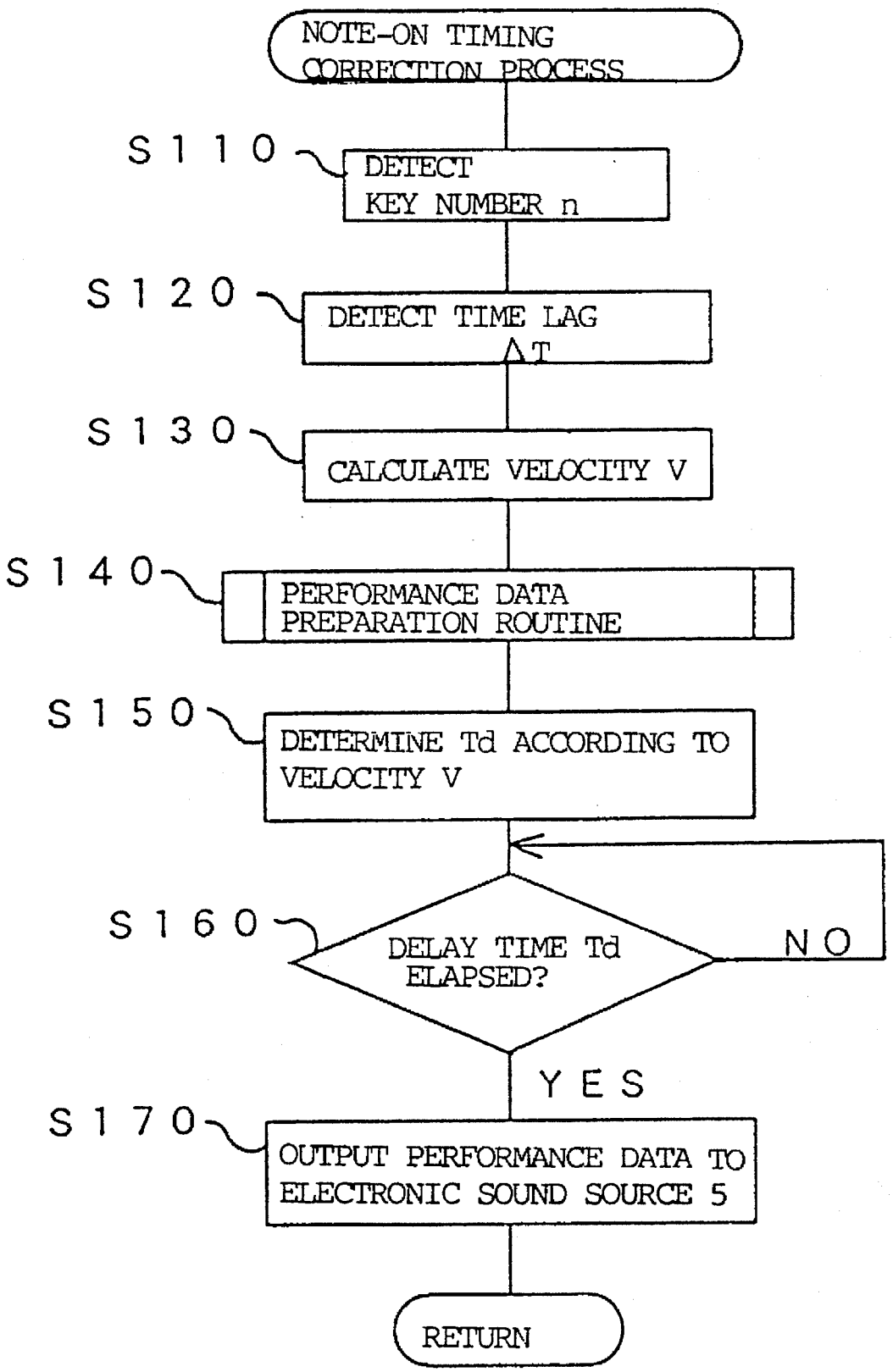
FIG. 5 is a flowchart showing the note-on timing correction process in the embodiment.

FIG. 1 is an explanatory view schematically showing the construction of the instant embodiment. FIG. 2 is an explanatory view of the interior structure of the upright piano of the instant embodiment. FIG. 3 is a perspective view of a lever elevation mechanism of the instant embodiment. FIG. 4 is a block diagram showing control means of the upright piano of the instant embodiment. FIG. 5 is a flowchart showing the note-on timing correction process in the embodiment. FIG. 6 is an explanatory view of the note-on timing.

An upright piano 1 of the present embodiment has, as shown in FIG. 1, a built-in electronic sound source 5 in addition to a string striking mechanism 3 of the state of the art. When a switch 7 of the upright piano 1 is set at an acoustic mode 7*a*, the piano 1 generates sound as an acoustic piano at the string striking mechanism 3. On the other hand, when the switch 7 is set at an electronic sound source mode 7*b*, operation on a keyboard 2 of the upright piano 1 results in generation of play sound at the electronic sound source 5. The play sound created at the electronic sound source 5 can be heard through a headphone 9 connected to an output terminal of the upright piano 1.

The upright piano 1 has a string striking mechanism 3 (see FIG. 1) which includes: key 11 which is moved up and down in accordance with the operation by a player; capstan screw 12 which elevates when the key 11 is depressed; wippen 15 pivotally fixed to center rail 14 via wippen flange 13 to pivot upward in response to the elevation of the capstan screw 12; jack 17 pivotally connected to the wippen 15 to elevate, together with the wippen 15, until its jack tail 17*a* abuts a regulating button 16; butt 18 which abuts and retracts off of the jack 17 and is pivotally supported at center pin 18*b* of butt flange 18*a* fixed to the center rail 14; hammer shank 21 fixedly inserted to the butt 18 to pivot counterclockwisely as the butt 18 is nudged by the jack 17; catcher shank 19 fixedly inserted to the butt 18 and extending transversely to the hammer shank 21; catcher 20 mounted at an end of the catcher shank 19; hammer 23 mounted at an end of the hammer shank 21; string 25 to be struck by the hammer 23; and hammer rail 28 having bumper part 28*a* mounted thereon to mitigate the sway of the hammer 23 by abutting a side of the hammer shank 21 when the hammer shank 21 swings back after striking string, as shown in FIG. 2.

Hammer shank stop rail 31, serving as interception means of the present invention, is supported by a rail actuating mechanism (see FIG. 3) which is fixed at both sides of the upright piano 1.

The rail actuating mechanism 35, as shown in FIG. 3, is constituted of pivotable lever 37, actuating lever 41 and lever actuating solenoid 36.

An end of the pivotable lever 37 is connected to an end of the actuating lever 41 via fixed shaft 39. Center shaft 38 penetrates the pivotable lever 37 and the actuating lever 41 at their substantial centers. The other end of the pivotable lever 37 has the hammer shank stop rail 31 fixed thereto. The hammer shank stop rail 31 has cushion felt 31*a* at its front face. On the other hand, the other end of the actuating lever 41 is connected to a plunger (not-shown) of the lever actuating solenoid 36. When the plunger projects, the actuating lever 41 pivots, together with the pivotable lever 37, around the center shaft 38 counterclockwisely in FIG. 3, and when the plunger retracts, they pivot clockwisely. As a result, the hammer shank stop rail 31 is positioned at a released position or an operation position, which will be described later, in response to projection and retraction of the plunger, respectively.

When the hammer shank stop rail 31 is set at the released position, the hammer shank stop rail 31, being fixed at the position indicated by the broken line in FIG. 2, is kept from abutting the hammer shank 21. Thus, the hammer 23 can strike the string 25. On the other hand, when set at an operation position, the hammer shank stop rail 31 is fixed at the position indicated by a bold line in FIG. 2 and abuts the hammer shank 21 at a specified position, thereby prohibiting the hammer 23 (see two dots dash line in FIG. 2) from hitting the string 25. In the present embodiment, a specified position is determined in the range between the point where the hammer 23 starts its inertial movement in response to the butt 18 retracting off of the jack 17 and the point where the hammer 23 reaches the string. The lever actuating solenoid 38 is actuated in cooperation with the switch 7 (see FIG. 1), and is set at the released position by projecting the plunger when the switch 7 is set at the acoustic mode 7*a*, or set at the operation position by retracting the plunger when the switch 7 is set at the electronic sound source mode 7*b*.

Further, as shown in FIG. 2, below the key 11 there are provided stepped shutter 61, key sensors 63, 65 to serve as the detection means for detecting the action related to key depression and key release. Each of the key sensors 63, 65 is comprised of a pair of light emitting element and light receiving element to generate an on-signal when there is a blockage between the both elements. When the key 11 is depressed, the stepped shutter 81 blocks the light path of the key sensors 83, 85 with a time lag.

As shown in FIG. 4, these key sensors 65 are connected to a control unit 71 serving as the control means and the delay time determination means. The control unit 71 is constituted as logic calculation circuit including a known CPU 72, ROM 73 and RAM 74, and connected to the key sensors 83, 85 via an input/output interface 75. The CPU 72 detects the timings and time lag of the light path blockage at the key sensors 83, 85, prepares performance data according to the control program stored in the ROM 73 and outputs it to the electronic sound source 5.

Event data constituting the performance data is comprised by units of 3 byte, 1 byte of which is a status byte and 2 bytes of which are data bytes. In the status byte data indicative of key depression (note-on) and key release (note-off) and other information are stored. In the data byte data indicative of the key number (note-number) corresponding to tone of the sound, key stroke intensity (velocity) corresponding to the sound volume and other information are stored.

Further, the control unit 71 is connected to pedal sensor (not-shown) for detecting action of pedal mechanism, such as dumper pedal and soft pedal. According to the detected information, various effects including damper effect are also incorporated into the performance data.

In the upright piano 1 having the above described construction, when the player chooses to quit performance using string striking-sound but to create sound from electronic sound source 5, the upright piano 1 is to be set at the electronic sound source mode *7b* by operating the switch 7 (see FIG. 1) of the control unit 71.

Under the situation, when the player depresses the key 11, the capstan screw 12 elevates and causes the wippen 15 to pivot upward, as shown in FIG. 2. The jack 17 also elevates, together with the wippen 15, and nudges the butt 18 to cause the hammer shank 21 to pivot counterclockwisely. Subsequently, as the jack 17 further elevates, the jack tail 17*a* abuts the regulating button 16, and the jack 17 swivels, in a great extent, around the wippen 15 clockwisely in that figure. As a result, the butt 18 retreats away from the jack 17 and starts its inertial movement together with the hammer shank 21.

As the hammer shank 21 proceeds with its inertial movement and reaches a position indicated by two-dots dash line in FIG. 2, it abuts the cushion felt 31*a* provided on front face of the hammer shank stop rail 31. At this moment, since the hammer shank 21 has not reached such position that the hammer 23 abuts the string 25, string striking sound is not generated.

On the other hand, when the key 11 is moved, the CPU 72 of the control unit 71 starts its note-on timing correction process shown in FIG. 5. The note-on timing correction process will be described hereinafter referring to FIGS. 5 and 6.

First, the key number n of the depressed key is detected, (step, which will be hereinafter referred to as "S" 110); the time lag Δ T (=T2–T1) between the timing T1 and T2 at which the stepped shutter 61 blocked the paths between the respective light emitting element and light receiving element of the key sensor 63, 65 is detected (S120) and then a velocity V is calculated according to the time lag Δ T (S130). Subsequently, according to these key depression information, performance data is prepared through the performance data preparation routine (S140). Further, by using a delay time determination table, a delay time Td (=T3–T2) corresponding to the calculated velocity V is determined (S150). Incidentally, the delay time determination table is provided with respect to each key, an example of which is shown below in Table 1.

TABLE 1

| | | | | | | | | |
|---|---|---|---|---|---|---|---|---|
| Velocity V | 0 | 1 | 2 | ... | 45 | 46 | ... | 127 |
| Delay Time Td (ms) | 100 | 98 | 96 | ... | 27 | 26 | ... | 5 |

Figure 6A:
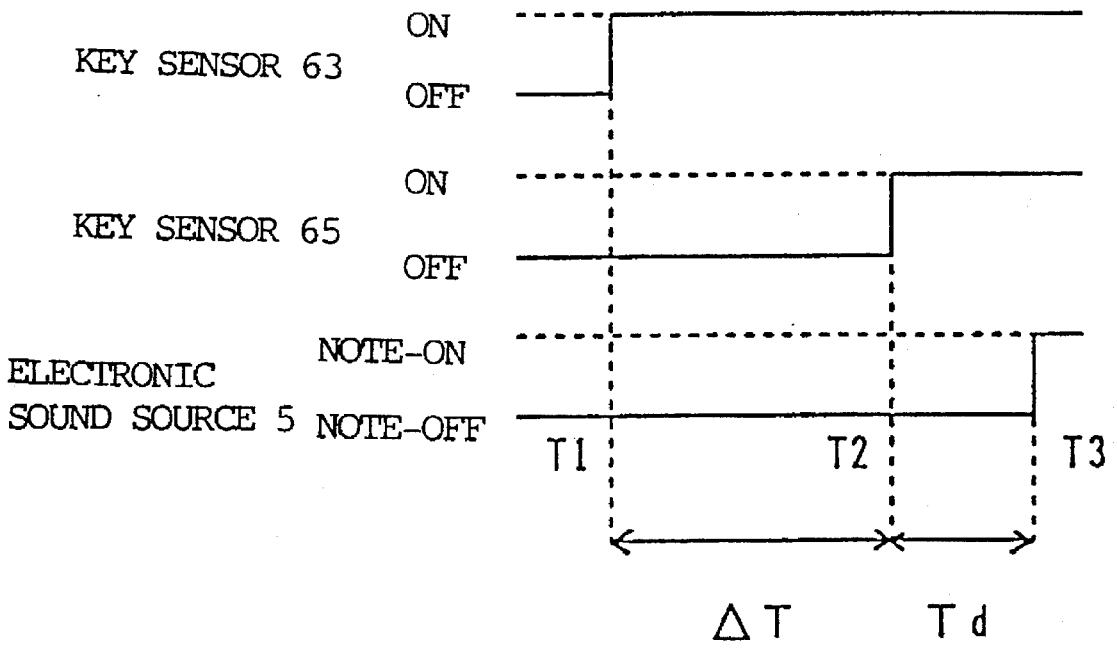
FIGS. 6A and B are an explanatory view of the note-on timing of the embodiment.
Figure 6B:
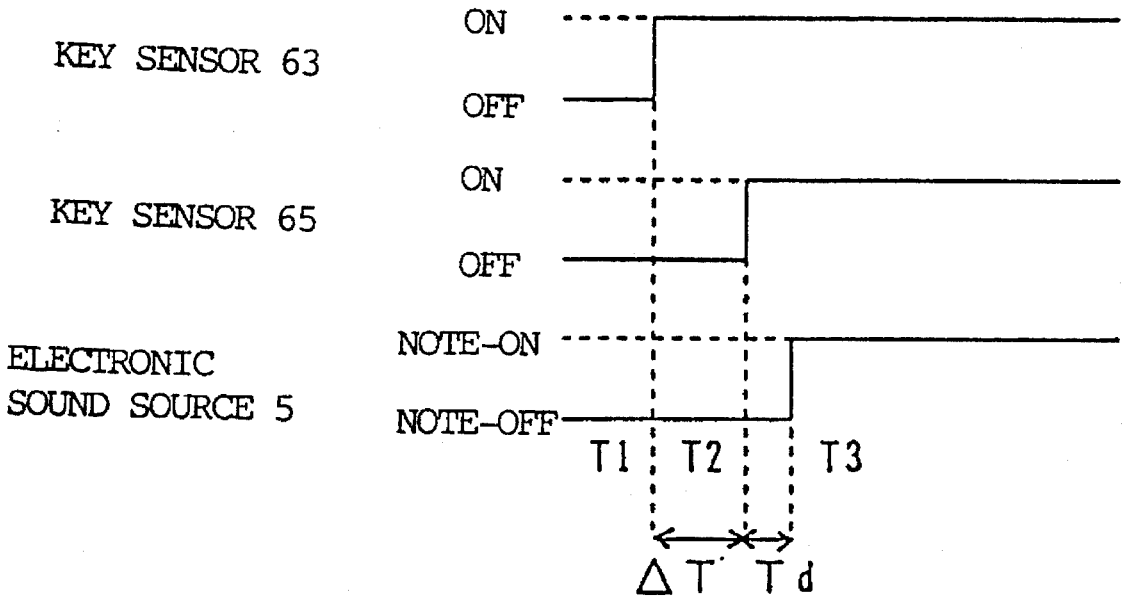

According to the delay time determination table, when the velocity V is small, i.e. when the time lag Δ T between the timing at which the key sensor 83 gave off an on-signal and the timing at which the key sensor 85 gave off an on-signal is great, a delay time Td is of a great value (FIG. 6A). On the other hand, when the velocity V is great, a delay time Td is of a small value (FIG. 6B). The delay time is thus predetermined with respect to each velocity according to the time period between key depression and generation of string striking sound in the acoustic mode *7a*.

Next, whether or not the time period Td has elapsed is determined (S160). The step of S180 is repeated until the time period has elapsed. When the time period Td has elapsed ("YES" at S160), the performance data is output to the electronic sound source 5 (S170). As a result, play sound is output with the time period Td based on the key depression intensity as an interval after key depression.

The described process at S110–140 and S170 correspond to the process of the control means of the present invention, and the process at S150 and S160 correspond to the process of the delay time determination means.

According to the upright piano 1 of the present embodiment, the following effects can be realized.

① The delay time Td for correcting the note-on timing is determined according to the velocity V and by using the delay time determination table predetermined with respect to each key. Therefore, in both cases where the switch 7 is set at the acoustic mode *7a* and at the electronic sound source *7b*, performance can be created with the same note-on timing. Accordingly, even after changing the mode at the switch 7, there is no difference of balance in the performance as a whole between these two modes. Consequently, regardless of which mode a player selects, he does not feel awkward during his play.

② Since the delay time Td is determined according to the velocity V i.e. key depression intensity, the note-on timing during play at the acoustic mode *7a* can be faithfully imitated.

③ Because of the provision of the delay time determination table for each key, the variation of the delay time due to the variant weight of hammers and the difference of string striking mechanism for each key can be incorporated into the determined delay time.

④ The string striking-sound that would be created when the player operates the key 11 is killed off by intercepting the movement of the hammer 23, thereby allowing the play sound to be released only from the electronic sound source 5. In this case, since the interception takes place after the hammer 23 has started its inertial movement, the feel of the key 11 is not different from that of the play with the string striking-sound.

Despite the embodiment of the present invention which has been described above, the present invention is not limited by the embodiment but intended to include all various modes of the invention within the scope and spirit of the claimed subject.

For instance, instead of the delay time determination table, a predetermined calculation formula or other calculation may be used to determine the delay time according to velocity V. Moreover, whereas in the described embodiment the delay time determination table is provided with respect to each key, the table may be provided with respect to each octave.

Further, the delay time determination means may be constructed as a delay circuit, and further, the delay time determination means may be provided at the side of the electronic sound source 5, whereby the performance data outputted from the control unit 71 is executed after a delay time has elapsed.

Still further, since the note-on timing of each key in the ordinary piano changes in time, the present mechanism may have the function to occasionally up-date the delay time determination table, to reflect such changes. For instance, velocity Va is first obtained according to the time lag Δ Ta between the timing at which the key sensor 83 gives off an on-signal and the timing at which the key sensor 65 gives off an on-signal. Then, the time Tdr between the timing at which the key sensor 65 actually gave off an on-signal and the timing at which a string striking sound was actually emitted is obtained for each key. Subsequently, by dividing the value Tdr by the delay time Tda corresponding to the velocity Va in the delay time determination table, a value of Tdr/Tda is obtained, which may be used as a correction coefficient in the occasional up-dating of the delay time determination table. If such up-dating function is included, for all the chronological changes in the string striking mechanism of the piano, the mechanism of the present invention can eliminate the difference of note-on timing between the play as a normal piano and the play using the electronic sound source.

In addition, although in the described embodiment the electronic sound source is incorporated into the piano, the same effect can be obtained by connecting an external electronic music instrument as the electronic sound source.

Industrial Applicability

As described above, in a piano which is enable to provide performance using electronic sound source as well as normal piano play, the piano according to the present invention eliminates the difference of balance between the normal piano play and the play using electronic sound source. Therefore, no matter which of the normal piano play or play using electronic sound source the player selects, he does not feel awkward in his performance.

I claim:

1. A composite acoustic/electronic piano having hammers, strings, a keyboard having a plurality of keys, a string striking mechanism operably connecting each of the hammers to a corresponding one of said keys to cause the hammers to strike the strings and generate string striking sound in response to operation of the keys, an electronic sound source, and a control means operably connected to said keys and said electronic sound source to control the electronic sound source to generate electronic sound in response to operation of the keys, wherein said control means comprises:

a mode selection means for selecting either one of a) an acoustic mode in which the string striking mechanism causes the hammers to strike the strings and generate string striking sound, and b) an electronic mode in which the control means controls the electronic sound source to generate electronic sound;

interception means for intercepting action of the hammers when the electronic mode is selected, to prevent the hammers from striking the strings and generating string striking sound;

the control means being operably connected to the keys via detection means for detecting depression and release of each of said keys and transmitting corresponding information to said control means, whereby the control means controls the electronic sound source according to the information sent from said detection means; and delay time determination means for determining a delay time by which sound emission at the electronic sound source is delayed after detection of key depression by the detection means;

wherein the delay time determination means includes a delay time determination table associated with each key, each delay time determination table containing predetermined delay times for the associated key that correspond to a delay time between key depression and string striking sound of the associated key in the acoustic mode, such that delay time variations between the keys, caused by variant hammer weights and different sting striking mechanisms, are incorporated into the predetermined delay times.

2. The piano according to claim 1, wherein the detection means further detects key depression intensity of each key and transmits corresponding information to said control means;

each delay time determination table contains predetermined delay times for the associated key that vary according to key depression intensity; and the predetermined delay times for each of the keys are relatively Short for relatively large key depression intensities and relatively long for relatively small key depression intensities.

3. A composite acoustic/electronic piano having hammers, strings, a keyboard with a plurality of keys, a string striking mechanism operably connecting each key to a corresponding hammer such that key depression causes the corresponding hammer to strike a string and generate a string striking sound, an electronic sound source, and control means operably connected to the keys and electronic sound source for controlling the electronic sound source such that key depression generates electronic sound, the control means comprising:

mode selection means for selecting one of:

i) an acoustic mode in which the string striking mechanism causes the hammers to strike the strings and generate string striking sound, and ii) an electronic mode in which the control means controls the electronic sound source to generate electronic sound;

interception means for intercepting hammer action when the electronic mode is selected, to prevent the hammers from striking the strings and generating string striking sound;

detection means for detecting depression and release of the keys and transmitting corresponding information to said control means, the detection means operably connecting the keys to the control means, whereby the control means controls the electronic sound source according to the information transmitted from the detection means;

delay time determination means for determining a delay time by which sound emission from the electronic sound source is delayed after detection of key depression by the detection means, the delay time determination means including a delay time determination table with predetermined delay times for the keys;

the predetermined delay times corresponding to actual delay times between key depression and string striking sound in the acoustic mode; and update means for updating the delay time determination table to compensate for variations of actual delay times in the acoustic mode over time and between pianos by:

i) determining the actual delay time between detection of key depression and detection of a resulting string striking sound in the acoustic mode; and ii) dividing the actual delay time by the predetermined delay time for the depressed key contained in the delay time determination table to obtain a correction coefficient for updating the predetermined delay time for the depressed key contained in the delay time determination table.

4. The piano according to claim 3, wherein the detection means further detects key depression intensity of the keys and transmits corresponding information to said control means;

the delay time determination table contains predetermined delay times for the keys that vary according to key depression intensity; and the predetermined delay times for the keys are relatively short for relatively large key depression intensities and relatively long for relatively small key depression intensities.

5. The piano according to claim 3, wherein said delay time determination means includes a delay time determination table associated with each key.

6. A composite acoustic/electronic piano having hammers, strings, a keyboard with a plurality of keys, a string striking mechanism operably connecting each key to a corresponding hammer such that key depression causes the corresponding hammer to strike a string and generate a string striking sound, an electronic sound source, and control means operably connected to the keys and electronic sound source for controlling the electronic sound source such that key depression generates electronic sound, the control means comprising:

mode selection means for selecting one of:

i) an acoustic mode in which the string striking mechanism causes the hammers to strike the strings and generate string striking sound, and ii) an electronic mode in which the control means controls the electronic sound source to generate electronic sound;

interception means for intercepting hammer action when the electronic mode is selected, to prevent the hammers from striking the strings and generating string striking sound;

detection means for detecting depression and release of the keys, detecting key depression intensity of the keys and transmitting corresponding information to said control means, the detection means operably connecting the keys to the control means, whereby the control means controls the electronic sound source according to the information transmitted from the detection means;

delay time determination means for determining a delay time by which sound emission from the electronic sound source is delayed after detection of key depression by the detection means, the delay time determination means including a delay time determination table with predetermined delay times for the keys;

the predetermined delay times corresponding to actual delay times between key depression and string striking sound of the keys in the acoustic mode and varying according to key depression intensity; and update means for updating the delay time determination table to compensate for variations of delay time in the acoustic mode over time and between pianos by:

i) determining the actual delay time between detection of key depression and detection of a resulting string striking sound in the acoustic mode; and ii) dividing the actual delay time by the predetermined delay time for the depressed key and the detected key depression intensity contained in the delay time determination table to obtain a correction coefficient for updating the predetermined delay time for the depressed key and the detected key depression intensity contained in the delay time determination table.

7. The piano according to claim 6, wherein said delay time determination means includes a delay time determination table associated with each key.

8. The piano according to claim 6, wherein the predetermined delay times are relatively short for relatively large key depression intensities and relatively long for relatively small key depression intensities.

* * * * *